United States Patent [19]

Kucza et al.

[11] 4,297,777

[45] Nov. 3, 1981

[54] METHOD FOR THE PRODUCTION OF A COMPOSITE HOLLOW BODY

[75] Inventors: Jean-Claude Kucza, St. Egreve; Albert Mastrot, St. Martin le Vinoux; Rene Perrot, Issoire; Jean-Mary Wattier, Montreuil Juigne, all of France

[73] Assignee: Cegedur Societe de Transformation de l'Aluminium Pechiney, Paris, France

[21] Appl. No.: 147,228

[22] Filed: May 6, 1980

[30] Foreign Application Priority Data

May 16, 1979 [FR] France ..... 79 13289

[51] Int. Cl.[3] ..... B22F 3/24

[52] U.S. Cl. ..... 29/420; 29/420.5

[58] Field of Search ..... 29/420, 420.5

[56] References Cited

U.S. PATENT DOCUMENTS 3,892,030 7/1975 De Pierre et al. ..... 29/420

4,099,314 7/1978 Perrot et al. ..... 29/420

4,135,922 1/1979 Cebulak ..... 29/420

*Primary Examiner*—Nicholas P. Godici

*Assistant Examiner*—V. K. Rising

*Attorney, Agent, or Firm*—Dennison, Meserole, Pollack & Scheiner

[57] ABSTRACT

A method for the production of a composite hollow body formed of aluminum alloys and composed of two layers having differing structure. One layer of the hollow body is intended to operate in contact with a mobile surface and is produced by extruding a mixture of particles of a hypereutectic silicon alloy having fine grains and an addition product. The other layer is selected from among alloys having certain particular properties and has the structure of a cast and wrought product. The present method particularly consists of the step of joining the two layers by coextrusion on a mandrel in an inverse extrusion press. The composite hollow bodies so produced are used in the production of linings for internal combustion engines or for jacks.

7 Claims, 2 Drawing Figures

METHOD FOR THE PRODUCTION OF A COMPOSITE HOLLOW BODY

BACKGROUND OF THE INVENTION

1. Field of the Invention

The invention relates to a method for the production of a composite hollow body formed of aluminum alloys, the body being comprised of two layers of differing structure. The two layers are joined together perfectly, one of the layers being intended to operate in contact with a mobile surface, this layer being thereby useful as an internal combustion engine lining, a jack case, or any hollow body having a profile which is stationary or slightly variable over its length and which must have good resistance to friction.

2. Description of the Prior Art

In current technology, hollow bodies used in the manufacture of internal combustion engine linings are formed from a single material, such as cast iron or an aluminum alloy having a high silicon content. Prior methods for producing such a cast iron body include centrifugal casting. Such articles formed of aluminum alloy may either be molded or extruded by impact of cast discs as claimed in French Pat. No. 2,344,358, or, alternatively, by extrusion of particles as described in French Pat. No. 2,343,895. According to the extrusion method, the lining which is obtained has a particularly fine structure in which primary silicon crystals may have dimensions of less than 5 μm. When the molding method is used, dimensions of less than 20 μm cannot be obtained. The fine structure previously produced by the referenced extrusion process is particularly favorable in reducing the binding tendency of the linings, particularly when the linings operate in contact with pistons formed of aluminum alloy. In addition, the products formed by the particle extrusion method are easily machinable and allow the use of alloys which cannot be obtained by other production methods. Further, the addition of addition products, such as graphite, tin, or silicon carbide, to the linings formed by the particle extrusion method have greatly improved friction resistance. However, problems arise when hypereutectic silicon alloy mixtures and addition products are shaped as a tube by extrusion and then machined to produce a lining. In particular, it is difficult to avoid considerable adhesion to the tools and notably to the extrusion mandrel which necessitates working on a bridge die while applying considerable extrusion pressure. Moreover, the use of hypereutectic silicon alloys in the divided condition increases the cost price of the linings relative to the cost price which could be obtained using alloys shaped by means of casting. The present invention finds particular solution to the aforementioned problems by providing a method for producing a composite hollow body by particle extrusion techniques, the present method retaining the economical advantages of such techniques while eliminating certain vexing technical disadvantages associated therewith.

SUMMARY OF THE INVENTION

The invention provides a method for the production of a composite hollow body formed of aluminum alloys wherein the body is composed of two layers of differing structure. Such bodies formed according to the present invention are comprised of a first layer which is intended to contact a mobile surface and a second layer which is joined to said first layer. The first layer is produced by extrusion of a mixture of particles comprised of a hypereutectic silicon alloy having fine grains and an addition product. The second layer is formed from particular aluminum alloys and has the conformation of a cast and wrought product. The present method particularly comprises the step of joining the two layers by co-extrusion on a mandrel in an inverse extrusion press. The articles produced according to the invention are particularly used in the production of linings for internal combustion engines and similar use environments.

It is therefore an object of the present invention to provide a method for producing a composite hollow body formed of aluminum alloys and being comprised of two layers having differing structure, one of the layers being intended to operate in contact with a mobile surface and being produced by extrusion of a mixture of particles of a hypereutectic silicon alloy having fine grains and an addition product.

It is a further object of the invention to provide a method for the production of a composite hollow body formed of two layers, one of the layers being formed of a mixture of particles of a hypereutectic silicon alloy having fine grains and an addition product and the other layer being formed of aluminum alloys having a cast and wrought structure, the two layers being joined by coextrusion on a mandrel in an inverse extrusion press.

Further objects and advantages of the invention will become more readily apparent in light of the following detailed description of the preferred embodiments.

DESCRIPTION OF THE PREFERRED EMBODIMENTS

Figure 1:
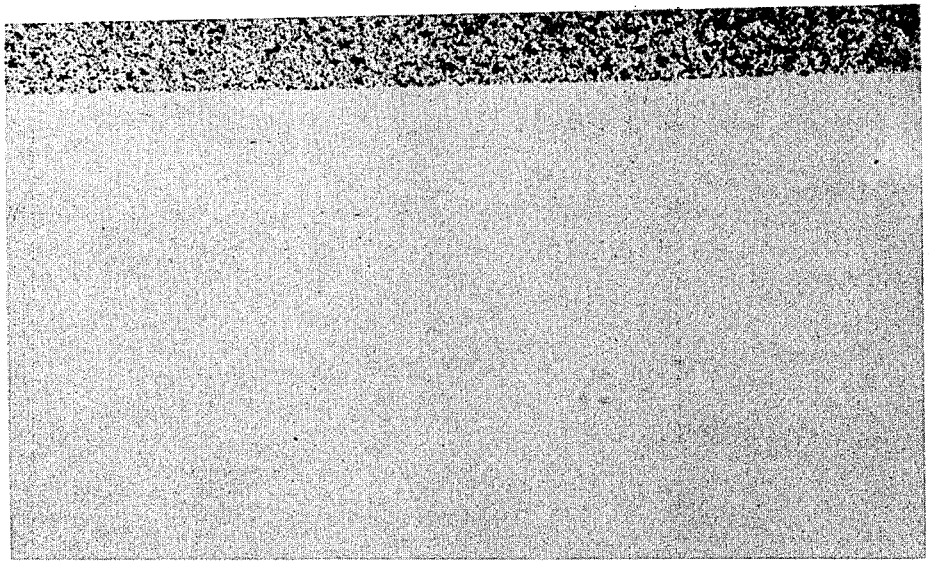
FIG. 1 is a photomicrograph illustrating a magnified longitudinal section of a single plate formed according to the invention, the plate being a part of a hollow body of alloy 2017 forming a cast part and an alloy of the series 4000 (A-S17U4) mixed with graphite for the active portion.

The composite hollow body of aluminum alloys formed according to the invention is formed of two layers having differing structure, one layer being intended to operate with its external surface in contact with a mobile surface. This first layer is formed of a hypereutectic silicon alloy with grains of primary silicon having dimensions of less than 20 μm and having a structure peculiar to that resulting from the extrusion of metallic particles with which an addition product has been mixed. The second layer has the structure of a cast product which has been wrought. The hollow body formed according to the invention does not comprise a single homogeneous layer of aluminum alloy, but comprises two superimposed layers of differing structure.

The first layer of the hollow body operates with its external surface in contact with a mobile surface, this first layer being referred to as the active layer. The active layer is formed of a hypereutectic silicon alloy obtained by the extrusion of metallic particles which have been mixed with an addition product. On one hand, due to the method of production of the particles by rapid cooling, this process allows the production of a grain of primary silicon of small dimensions generally between 2 and 5 μm and at any rate lower than 20 μm. On the other hand, due to the extrusion shaping method, a structure is formed in which the alloy constituents and the addition products are aligned according to a privileged direction. Also, due to the divided condition of the starting material, the oxygen content of the silicon alloy is between 100 and 15000 ppm.

The second layer has a conventional structure of a cast product which has been wrought. The two layers are joined together perfectly so that they do not have a thermal resistance when calories are released during combustion, such as when the article is used as the lining of an internal combustion engine. In such a situation, the active layer is usually positioned inside the second layer of the hollow body.

The composition of the active layer is generally a silicon aluminum alloy having a content of silicon approaching or greater than 12% and containing from 1 to 5% of copper and from 0.5 to 1.5% of magnesium to which an addition product is added by mixing the powders before extrusion in a quantity of from 0.5 to 5% by weight. The addition product can be taken to be graphite, tin or silicon carbide, these addition products being intended to give the obtained hollow bodies either particular hardness properties, such as occurs with the use of silicon carbide, or a resistance to friction, such as is imparted by tin or graphite. However, it is naturally understood that the scope of the invention includes the use of an alloy without addition products.

The non-active or second layer is preferably formed of an aluminum alloy containing elements of variable alloys according to the properties which are intended to be obtained. For example, these may be alloys 2017, 4032, and others. The composite hollow body so formed allows certain technical and economic problems to be resolved which were faced with the monolayer hollow bodies of the prior art. From the economical point of view, the fact of joining the active layer to an alloy layer obtained by casting contributes the properties of mechanical strength to cold and heat and enables the thickness of the active layer to be reduced. Consequently, a reduction is allowed in the quantity of metallic particles necessary for the constitution of the hollow body to between 20 and 50% of the quantity used in the linings of the prior art, thereby providing a healthy reduction of costs. From the technical point of view, the problems faced during the extrusion of the hollow body are brought back to the level of the pre-extrusion of an active layer produced with lower extrusion ratios which are compatible with the present material. It is therefore possible to select the tools and to reduce the adhesive problems. By a suitable choice of the composition of the alloy of the non-active layer, this composite structure thus allows the acquisition of the properties in relation to the desired use such as for example mechanical resistance to an ambient temperature or to heat, resistance to fatigue, thermal expansion coefficient, resistance to corrosion, thermal conductivity, and others. Thus, in the same lining, properties are exhibited which cannot be obtained from a single given alloy.

The particular method of the invention is capable of producing composite hollow bodies of this type is an economical manner from its components. The method comprises extruding a hollow cylinder intended to form one of the layers of the hollow body, using a press fitted with a bridge die, from a mixture of metallic particles of a hypereutectic silicon alloy and an addition product, subsequently placing the cylinder inside a hollow billet obtained by casting an aluminum alloy and intended to form the other layer, and finally co-extruding the entirety on the mandrel of an extrusion press, for example by inversed extrusion or direct lubricated extrusion, in order to obtain constant thicknesses.

Accordingly, the first stage of the method comprises initially forming the hollow body having an active surface. In order to accomplish this formation, a hypereutectic silicon aluminum alloy is produced by pulverization (atomization or centrifugation) in the form of particles of a grain size between 5 μm and 2 mm. These particles are mixed with an addition product of a comparable grain size, the mixture being compressed in the form of a slug in a mechanical press with a lubricated container under a pressure of several hundreds of MPa or compressed in an isostatic press which does not require lubrication. The slug so produced is roughened, if it carries traces of lubrication, then heated to between 400° and 500° C. and finally extruded in the form of a hollow cylinder in a press fitted with a bridge die of the Spider or Porthole type with an extrusion ratio of between 2 and 10. According to a variation of the method, it is possible to directly charge the mixture of hypereutectic silicon alloy and addition product in the container of the extrusion press without having performed an initial compression.

A hollow billet of dimensions compatible with those of the hollow cylinder having an active surface is produced by casting, followed by boring or machining. The hollow billet is intended to form the inactive outer layer of the composite hollow body. The hollow cylinder is then inserted inside the hollow billet. According to a variation of the invention, the hollow billet may be bored followed by a reheating step before proceeding to the insertion of the hollow cylinder in order to produce an improved joint. This step prevents the extrusion lubricant from penetrating between the two components and improves the mechanical strength of the assembly.

Figure 2:
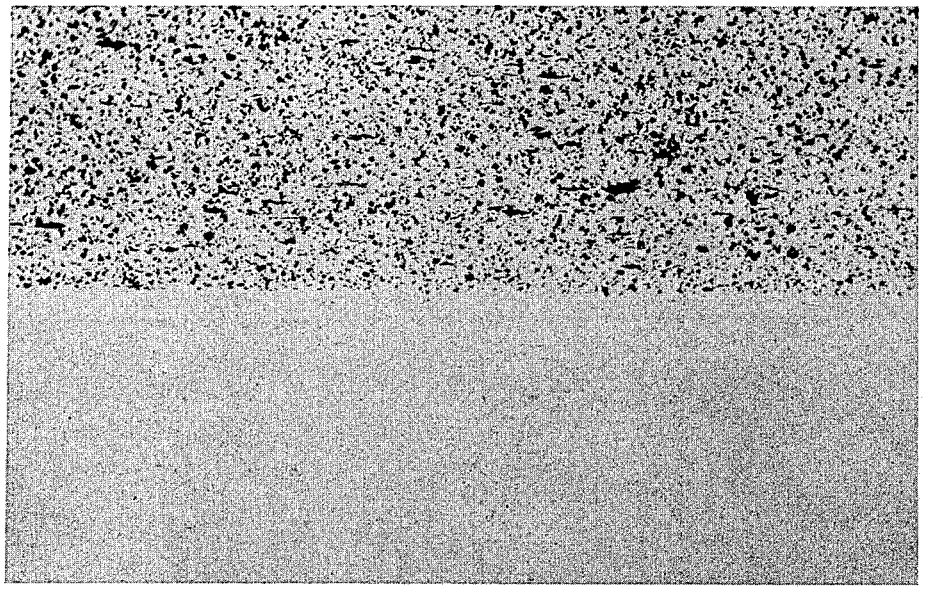
FIG. 2 is a photomicrograph of the structure shown in FIG. 1 but having a greater magnification to allow improved distinguishment of the structural differences.

The third stage of the method consists in charging all the elements thus obtained in the container of an extrusion press and in coextruding all elements in order to obtain the composite hollow body, which is then sliced to the required lengths. During this operation, the extrusion ratio used is between 10 and 50. The composite hollow body which is thus produced exhibits at the level of the adjacent surfaces of the components a perfect adherence as the micrographs of the single plate shown in FIG. 1 reveal, FIG. 1 being a longitudinal section under a magnification of 50 of a hollow body of alloy 2017 for the cast part and an alloy of the series 4000 (A-S17U4) mixed with graphite for the active part. In the lower inactive layer, the wrought structure of alloy 2017 is distinguished from the upper active layer in which the issuing extruded structure of particles including the addition products is seen to be aligned in the direction of extrusion. Graphite is the addition product shown in the active layer of FIG. 1. The fineness of the grains of primary silicon is also seen. FIG. 2 is a micrograph obtained from the same hollow body, but under a magnification of 200, which allows the differences in structure to be better distinguished.

The following examples will assist in gaining a better comprehension of the invention.

EXAMPLE 1

An alloy of the series 4000 (A-S17U4) in the form of a powder of dimensions from 5 μm to 1 mm, obtained by means of atomization, is mixed with 3% by weight of powder graphite, then introduced into the lubricated conical container of a mechanical press and compressed at a pressure of 300 MPa in order to produce a slug of $\Phi=250$ mm and $1=500$ mm.

This slug is roughened to eliminate the lubricant and then heated to 450° C. prior to introduction into the container of a diameter of 255 mm of a horizontal extrusion press supplied with a bridge tool of the Spider type. The extrusion operation is then carried out using an extrusion ratio of 3.8, a hollow cylinder being thus obtained having an exterior diameter of 150 mm and an interior diameter of 75 mm. This cylinder is inserted inside a hollow billet of alloy 2017 previously bored to a diameter of 150 mm and heated. The assembly which is thus produced is coextruded inversely on a lubricated mandrel according to the conventional method with an extrusion ratio of 15. A composite hollow body is thereby produced having an exterior diameter of 98 mm and an interior diameter of 75 mm, the separation boundary of which between the two components being located on a cylindrical surface of 83 mm in diameter. The two components of the extruded tube are joined perfectly as can be seen from FIG. 1. This body required the use of only 30% of the weight of metallic particles necessary for the production of a hollow body of the same dimensions according to the prior art.

EXAMPLE 2

A mixture of an alloy of the series 4000 (A-S17U4) in powder form and graphite identical to that of Example 1, is charged at a temperature between 400° and 500° C. directly into the container of a vertical press supplied with a bridge tool, then extruded with an extrusion ratio of 2.5. A cylinder is obtained having an exterior diameter of 180 mm and an interior diameter of 81 mm which is positioned inside a hollow billet having an exterior diameter of 284 mm of alloy 2017, having been previously roughened and heated. Then, inverse coextrusion of all the elements is carried out according to an extrusion ratio of 32. The dimensions of the obtained composite hollow body are $89\times83.5\times78$ mm and the body only contains 47% by weight of alloy having required a previous pulverization.

EXAMPLE 3

The hollow cylinder based on a powder alloy is produced from the same elements as those in Example 2 and under the same conditions, except that the extrusion press is horizontal. This hollow cylinder is positioned inside a hollow billet made of alloy 4032 in order to produce a composite unit of dimensions of $205\times155\times75$ mm. The latter is then extruded inversely with an extrusion ratio of 29 producing a composite hollow body having dimensions of $83\times79\times75$ mm.

The use of the present invention is in the manufacture of linings for internal combustion engines intended to operate in contact with pistons of aluminum alloys, in the production of cases and generally in use environments where it is necessary to arrange parts which must have a good resistance to friction and a negligible tendency toward seizing.

It is understood that the invention is not to be limited by the explicit examples of the foregoing description of the preferred embodiments, but is to be interpreted in scope by the recitation of the appended claims.

What is claimed is:

1. A method for the production of a composite hollow body, comprising the steps of:

forming a hollow cylinder by extruding a mixture of metallic particles of a hypereutectic silicon alloy and an addition product;

forming a hollow billet by casting an aluminum alloy, the billet having a bore of a size adequate to receive the hollow cylinder thereinto;

inserting the hollow cylinder into the hollow billet; and co-extruding the cylinder and billet together to form the composite hollow body.

2. The method of claim 1 wherein the hollow cylinder is extruded on a press fitted with a bridge die.

3. The method of claim 1 wherein the cylinder and billet are co-extruded on a mandrel in an inverse extrusion press.

4. The method of claim 3 wherein the coextrusion ratio is between 10 and 50.

5. The method of claim 1 wherein the co-extrusion ratio is between 10 and 50.

6. The method of claim 1 wherein the hollow billet is roughened and heated before using inserted into the hollow cylinder.

7. The method of claim 1 wherein the hollow billet is formed of an alloy selected from the group consisting of aluminum alloys 2000 and 4000.

* * * * *